US007377758B2

(12) United States Patent
Sallows et al.

(10) Patent No.: US 7,377,758 B2
(45) Date of Patent: May 27, 2008

(54) FLUID PUMP

(75) Inventors: Geoffrey Sallows, Seaford (GB); Etienne Vincent Bunoz, Haylesham (GB)

(73) Assignee: Brightwell Dispensers Limited (GB)

( * ) Notice: Subject to any disclaimer, the term of this patent is extended or adjusted under 35 U.S.C. 154(b) by 589 days.

(21) Appl. No.: 10/934,397

(22) Filed: Sep. 7, 2004

(65) Prior Publication Data

US 2005/0079080 A1 Apr. 14, 2005

(30) Foreign Application Priority Data

Sep. 5, 2003 (GB) ..... 0320883.2

(51) Int. Cl.
*F04B 53/10* (2006.01)

(52) U.S. Cl. ..... 417/568; 251/327; 251/333

(58) Field of Classification Search ..... 417/568, 417/567; 137/512.4, 843
See application file for complete search history.

(56) References Cited

U.S. PATENT DOCUMENTS 4,084,606 A * 4/1978 Mittleman ..... 137/102
6,085,773 A * 7/2000 Karg et al. ..... 137/102
6,334,552 B1 * 1/2002 Bougamont et al. ..... 222/380
2003/0235509 A1 * 12/2003 Maki ..... 417/567

* cited by examiner

*Primary Examiner*—Devon Kramer
*Assistant Examiner*—Philip Stimpert
(74) *Attorney, Agent, or Firm*—Diller, Ramik & Wight

(57) ABSTRACT

A pump comprising a piston in communication with a valve chamber provided with a first valve seat and a second valve seat, and a resilient valve element comprising a first tapered portion, a second tapered portion and a flange portion extending from a periphery of the first tapered portion, in which the flange portion co-operates with the first valve seat to form an inlet valve, and the second tapered portion co-operates with the second valve seat to form an outlet valve, and in which negative pressure applied to the flange portion by the pressure means in use lifts it from the first valve seat, and positive pressure applied to the first tapered portion by the piston in use lifts the second tapered portion from the second valve seat.

22 Claims, 3 Drawing Sheets

A-A

FLUID PUMP

BACKGROUND OF THE INVENTION

This invention relates to a fluid pump provided with a novel valve element, for use particularly, but not exclusively, with a soap dispenser.

A fluid dispensing device can be provided with a pump comprising a fluid inlet, a priming cylinder with a piston, a fluid outlet, and a valve element disposed between the fluid inlet and the fluid outlet. The valve element is adapted to seal the fluid outlet when the cylinder is primed with fluid, and to seal the fluid inlet when said fluid is driven from the cylinder.

In one arrangement a conical flexible valve element is provided, which is disposed in compression between a relatively large inlet aperture, and a relatively small outlet aperture. The periphery of the valve element surrounds the inlet aperture, and the apex of the valve element is seated in the outlet aperture, thereby creating an inlet and an outlet seal. In use the periphery of the valve element is drawn away from the inlet aperture, and the apex is pressed into the outlet aperture when the cylinder is primed with fluid, and the periphery of the valve element is pressed against the surface around the inlet aperture, and the apex is drawn away from the outlet aperture, when said fluid is driven form the cylinder.

The valve element must be provided with a particular rigidity in order to provide adequate seals, and in particular to maintain one seal when the other is opened. As a result, a relatively large force may be required to manipulate the valve element as described above. This can put a strain on associated parts of a pump and reduce its life span.

SUMMARY OF THE INVENTION

It is the object of the present invention to provide a novel valve element construction.

According to the present invention a pump comprises pressure means in communication with a valve chamber provided with a first valve seat and a second valve seat, and a resilient valve element comprising a first tapered portion, a second tapered portion and a flange portion extending from a periphery of the first tapered portion, in which the flange portion co-operates with the first valve seat to form an inlet valve, and the second tapered portion co-operates with the second valve seat to form an outlet valve, and in which negative pressure applied to the flange portion by the pressure means in use lifts it from the first valve seat, and positive pressure applied to the first tapered portion by the pressure means in use lifts the second tapered portion from the second valve seat.

In a preferred construction the valve element can be mounted in compression between the first valve seat and the second valve seat. The first valve seat can taper in the opposite direction to the first tapered portion, such that the flange portion tapers away from the periphery of the first tapered portion in use. Preferably the flange portion is resiliently biased against the first valve seat.

The second valve seat can taper in a manner which corresponds to the second tapered portion.

The first tapered portion can be spaced apart from the second tapered portion, and a substantially non-tapering body portion can be disposed therebetween. This arrangement provides a sufficient space between the inlet and outlet valves for fluid to move freely through the valve chamber.

In one construction a nipple portion can be provided at the apex of the second tapered portion, which extends into an outlet conduit extending from the outlet valve. The nipple portion can be adapted to prevent the second tapered portion from becoming unseated form the second valve seat in use.

The valve element can be provided with a bore extending along its longitudinal axis. An upper portion of the bore can be defined by the first tapered portion, and a lower portion of the bore can extend through the body portion and the second tapered portion and into the nipple portion.

A rigid pin can be disposed inside the bore to limit lateral movement of the valve element in use. The pin can extend from a plate mounted above the valve, which holds it under compression, and which is provided with a number of apertures through which fluid can pass to enter the inlet valve.

The pressure means may be a cylinder extending from the valve chamber, provided with a piston. Movement of the piston away from the valve chamber in use creates a negative pressure therein and lifts the flange portion from the first valve seat. This negative pressure can be insufficient to lift the second tapered portion from the second valve seat, and hence the outlet valve remains sealed. Movement of the piston towards the valve chamber in use creates a positive pressure therein which forces the first tapered portion towards the first valve seat, and as a result the second tapered portion is lifted form the second valve seat. This positive pressure can also force the flange portion against the first valve seat, and hence the inlet valve remains sealed.

The pump can be adapted to dispense a viscous liquid, for example liquid soap. The soap can be contained in a cartridge, bag or refillable reservoir, which is mounted to one end of an inlet conduit, the opposite end of which is disposed the first valve seat. Movement of the piston down the cylinder opens the inlet valve and draws soap into the valve chamber and the cylinder. Movement of the piston back up the cylinder closes the inlet valve and opens the outlet valve as described above, and pumps the soap out of the outlet conduit.

The invention also includes a resilient valve element for use with a pump comprising pressure means in communication with a valve chamber provided with a first valve seat and a second valve seat, in which the a resilient valve element comprises a first tapered portion, a second tapered portion and a flange portion extending from a periphery of the first tapered portion, in which the flange portion co-operates with the first valve seat to form an inlet valve, and the second tapered portion co-operates with the second valve seat to form an outlet valve, and in which negative pressure applied to the flange portion by the pressure means in use lifts it from the first valve seat, and positive pressure applied to the first tapered portion by the pressure means in use lifts the second tapered portion from the second valve seat.

BRIEF DESCRIPTION OF THE DRAWINGS

The invention can be performed in various ways, but one example will now be described by way of example and with reference to the accompanying drawings in which.

DETAILED DESCRIPTION OF THE PREFERRED EMBODIMENTS

Figure 1:
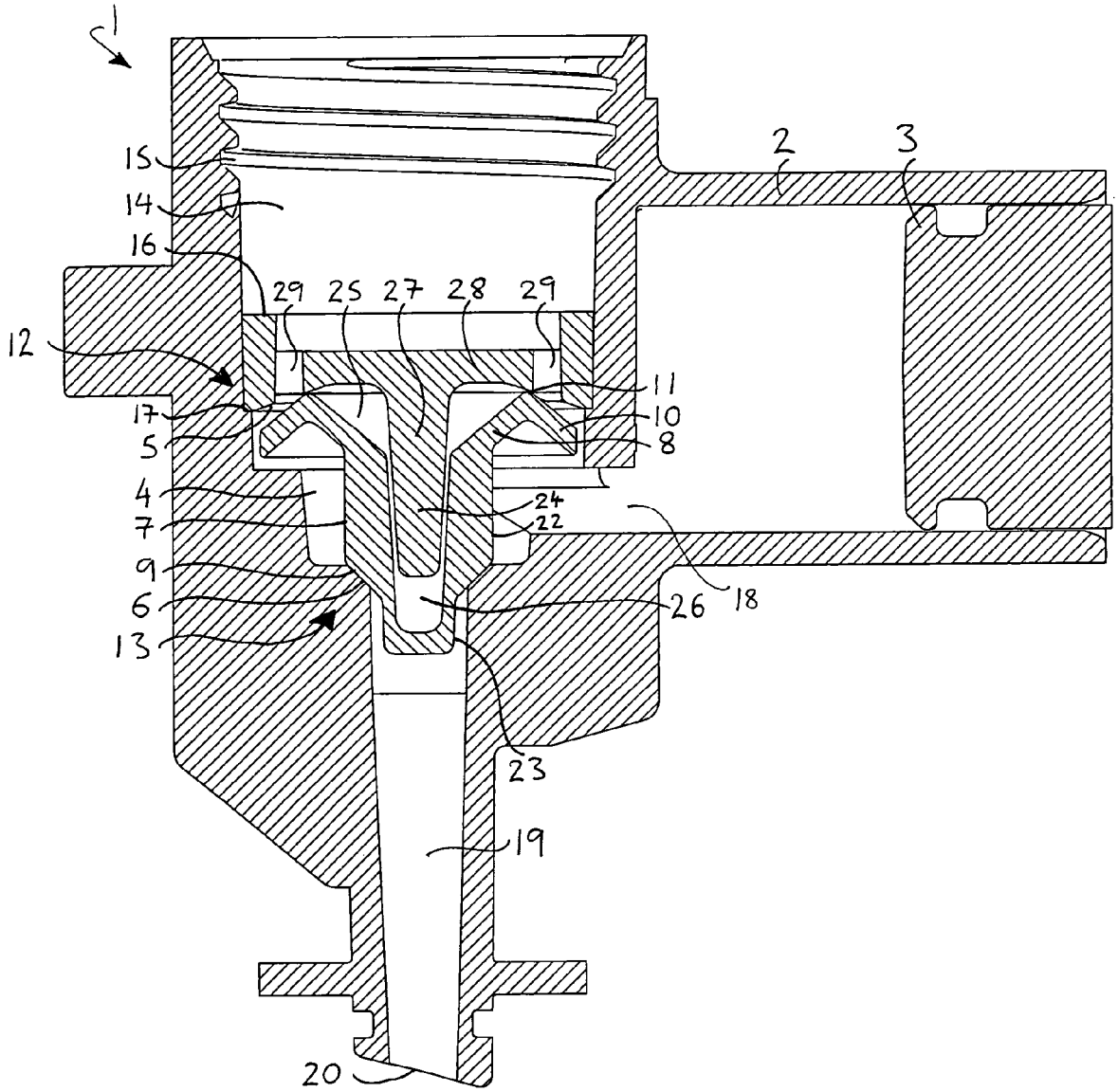
FIG. 1 is a cross-sectional view of a pump according to the present invention in a first arrangement.

In FIG. 1 a pump 1 comprises pressure means, in the form of cylinder 2 and piston 3, in communication with a valve chamber 4 provided with a first valve seat 5 and a second valve seat 6, and a resilient valve element 7.

The valve element 7 comprises first tapered portion 8, second tapered portion 9 and flange portion 10 extending from a periphery 11 of the first tapered portion 8.

The flange portion 10 co-operates with the first valve seat 5 to form an inlet valve 12, and the second tapered portion 9 co-operates with the second valve seat 6 to form an outlet valve 13.

Negative pressure applied to the flange portion 10 by the pressure means 2 and 3 in use lifts it from the first valve seat 5, and positive pressure applied to the first tapered portion 8 by the pressure means 2 and 3 in use lifts the second tapered portion 9 from the second valve seat 6.

The pump further comprises inlet conduit 14, which is provided with a screw thread 15, which is adapted to co-operate with a soap cartridge or bag (not shown). A ring 16 is provided inside the inlet conduit 14, which rests on ledge 17, and carries the first valve seat 5.

As is clear from FIG. 1 the cylinder 2 extends laterally from the valve chamber 4, and an aperture 18 is provided between the cylinder 2 and the valve chamber 4.

An outlet conduit 19 extends downward form the outlet valve 13, and is provided with a dispensing aperture 20 at its outer end.

The valve element 7 also comprises a body portion 22, which is disposed between the first tapered portion 8 and the second tapered portion 9. This arrangement provides a sufficient space between the inlet valve 12 and outlet valve 13 for the soap to move freely through the valve chamber 4.

A nipple portion 23 is provided at the apex of the second tapered portion 9, which extends into the outlet conduit 19.

The valve element 7 also has a bore 24, an upper portion of which 25 is defined by the first tapered portion 8, and a lower portion of which 26 extends through the body portion 22, the second tapered portion 9 and into a portion of the nipple portion 23.

A pin 27 is disposed inside the bore 24 to limit lateral movement of the valve element 7. The pin 27 extends from a plate 28 which is mounted in the ring 16, and which holds the valve element 7 under compression against the second valve seat 6. The plate 28 is provided with a number of apertures 29, through which fluid can pass to enter the inlet valve 12.

Figure 3:
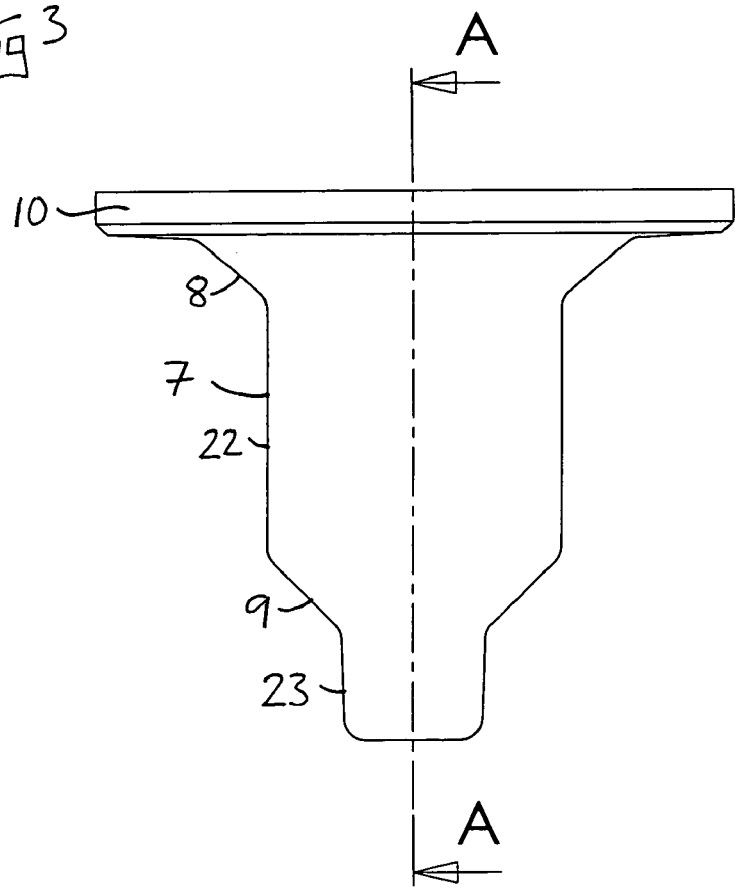
Figure 4:
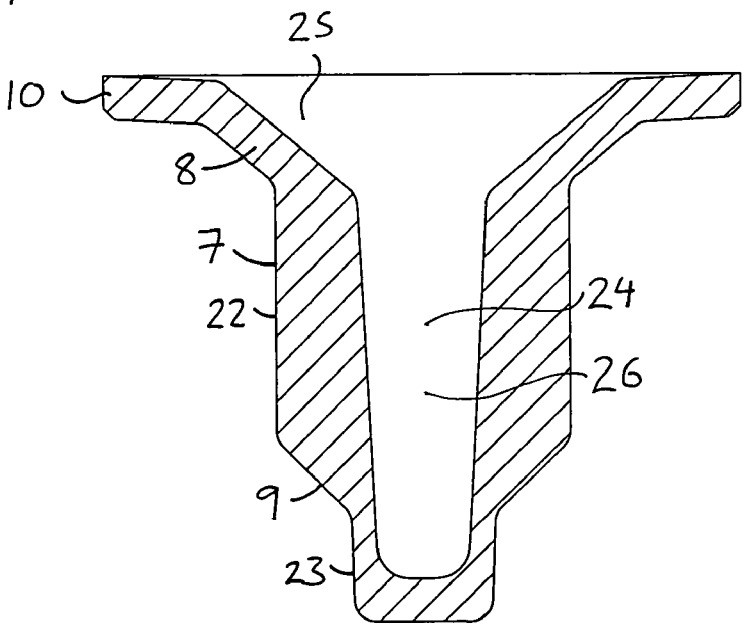

FIGS. 3 and 4 show the valve element 7 under no compression. As is shown in FIGS. 3 and 4, the flange portion extends substantially perpendicular to the longitudinal axis of the valve member 7.

Figure 2:
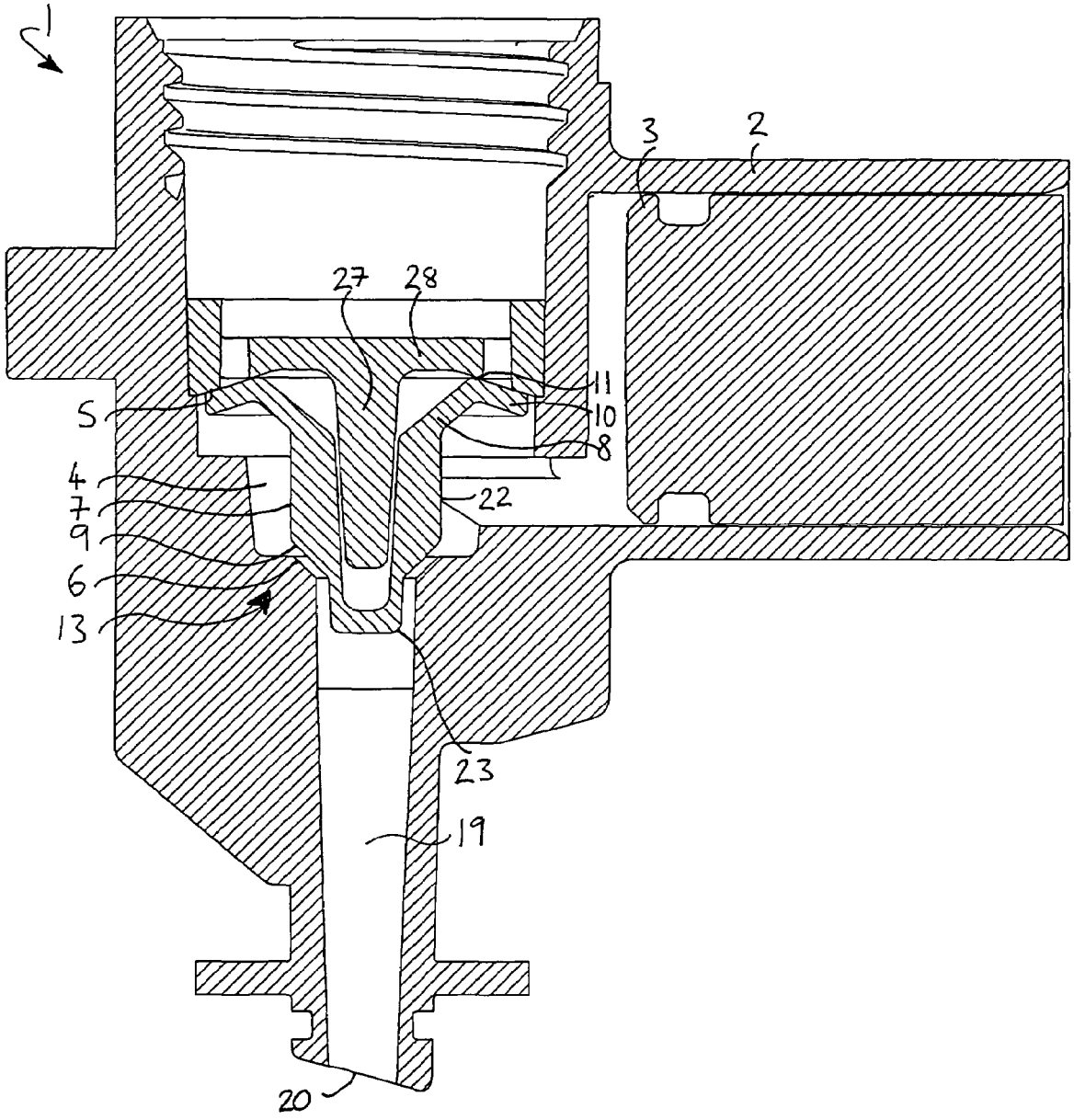
FIG. 2 is a cross-sectional view of a pump as shown in FIG. 1 in a second arrangement; and, FIG. 3 is a side view of a valve element as shown in the pump as shown in FIG. 1; and, FIG. 4 is a cross-sectional side view of the valve element as shown in FIG. 3.

When the valve element 7 is mounted in the pump 1 as shown in FIGS. 1 and 2, it is mounted under compression. The plate 28 presses down against the periphery 11 of the first tapered section 8, and hold the second tapered portion 9 against the second valve seat 6. This compression force is relatively low.

At the same time, the flange portion 10 is held down in the position as shown in FIG. 2, by the first valve seat 5, which is tapered in the opposite direction to the first tapered portion 8. The flange portion 10 is therefore resiliently biased towards the first valve seat 5.

In use the piston 3 is moved down the cylinder 2 in a priming stroke, as shown in FIG. 1. As a result a negative pressure is created inside the cylinder 2 and the valve chamber 4, and the flange portion 10 is lifted from the first valve seat 5, as shown in FIG. 1. The negative pressure required to lift the flange portion 10 from the first valve seat 5 is less than that required to lift the second tapered portion 9 from the second valve seat 6, and hence the outlet valve remains sealed. Soap is therefore drawn from the cartridge or bag (not shown), through the inlet conduit, through the apertures 29, through the inlet valve 12, and into the valve chamber 4 and the cylinder 2.

When a desired priming stroke has been completed, the piston 3 is moved back up the cylinder 2, in a driving stroke as shown in FIG. 2. As a result a positive pressure is created inside the cylinder 2 and the valve chamber 4. This pressure forces the first tapered portion 8 up against the plate 28, and as a result the second tapered portion 9 is lifted from the second valve seat 6, as shown in FIG. 2. The nipple portion 23 remains inside the outlet conduit 19, and prevents the valve element 7 from becoming unseated from the second valve seat 6. The positive pressure in the valve chamber 4 also applies against the flange portion 10, further biasing it against the first valve seat 5, and maintaining an effective seal. The soap drawn into the valve chamber 4 and the cylinder 2 during the priming stroke as described above, is therefore forced therefrom through the outlet valve 13, through the outlet conduit 19 and through the dispensing aperture 20, for use.

During both the priming and driving strokes negative and positive pressure is applied laterally to the body portion 22. However, the pin 27 prevent the body portion flexing enough to unseat the valve element 7.

During construction of the pump 1, the pin 27 and the nipple portion 23 also ensure that the valve element 7 can be readily positioned correctly in the valve chamber 4.

The embodiment can be altered without departing from the spirit of the invention. For example, it has been found in practice that the outlet valve 13 in the embodiment described above can suffer from leakage when the pump is used with certain fluids, due to insufficient sealing pressure. Therefore, in one alternative embodiment (not shown) a coil spring is mounted in compression around the pin 27, between the plate 28 and the top side of the first tapered portion 8. The coil spring provides an additional compression force to the outlet valve 13 in use, and helps to prevent possible leakage.

The invention also includes a resilient valve element for use with a pump as described above. Therefore, resilient valve element 7 is shown in FIGS. 3 and 4.

Thus a pump is provided with a resilient two-way valve element which requires relatively low forces to open and close an inlet and an outlet. The stresses placed on the associated parts of a pump are therefore reduced, and reliability is improved. In addition, the valve element 7 requires less rigidity than conventional conical valve elements, and its walls can therefore be provided with a thinner cross section, which is easier to manufacture.

Although a preferred embodiment of the invention has been specifically illustrated and described herein, it is to be understood that minor variations may be made in the apparatus without departing from the spirit and scope of the invention, as defined by the appended claims.

The invention claimed is:

1. A pump comprising pressure means (3) in communication with a valve chamber (4) provided with a first valve seat (5) and a second valve seat (6); a resilient valve element (7) including a first tapered portion (8), a second tapered portion (9) and a flange portion (10) extending radially outwardly from a periphery of the first tapered portion (8); the flange portion (10) cooperates with the first valve seat (15) to form an inlet valve; the second tapered portion (9) co-operates with the second valve seat (6) to form an outlet valve; and negative pressure applied to the flange portion (10) by the pressure means (3) in use lifts the flange portion (10) from the first valve seat (5), and positive pressure applied to the first tapered portion (8) by the pressure means (3) in use lifts the second tapered portion (9) from the second valve seat (6).

2. A pump as claimed in claim 1 in which the valve element is mounted in compression between the first valve seat and the second valve seat.

3. A pump as claimed in claim 2 in which the resilient valve element has a longitudinal axis, the first tapered portion tapers in a first direction along said axis, the first valve seat tapers in the opposite direction to the first direction, such that when the flange portion cooperates with the first valve seat in use, it tapers in the opposite direction along said axis to the first tapered portion.

4. A pump as claimed in claim 3 in which the flange portion is resiliently biased against the first valve seat.

5. A pump as claimed in claim 4 in which the second valve seat tapers in a manner which corresponds to the second tapered portion.

6. A pump as claimed in claim 1 in which a negative pressure required to lift the flange portion from the first valve seat is less than a negative pressure required to lift the second tapered portion from the second valve seat, such that in use when a negative pressure is applied to the valve chamber the inlet valve opens and the outlet valve does not.

7. A pump as claimed in claim 6 in which the first tapered portion is spaced apart from the second tapered portion, and a substantially non-tapering body portion is disposed therebetween, such that a space is defined between the inlet valve and the outlet valve for a fluid to move freely through, and be contained in, the valve chamber in use.

8. A fluid pump as claimed in claim 7 in which a nipple portion is provided at an apex of the second tapered portion, which in use extends into an outlet conduit extending from the outlet valve, in which a portion of the nipple portion remains inside the outlet conduit when the outlet valve is open in use such that the second tapered portion is prevented from becoming unseated from the second valve seat in use.

9. A pump as claimed in claim 8 in which the valve element is provided with a bore extending along its longitudinal axis, in which an upper portion of the bore is defined by the first tapered portion, and in which a lower portion of the bore extends through the body portion and the second tapered portion and into the nipple portion.

10. A pump as claimed in claim 9 in which a rigid pin is disposed inside the bore to limit lateral movement of the valve element in use.

11. A pump as claimed in claim 10 in which the rigid pin extends from a plate mounted above the valve, in which the plate holds the valve element under compression, and in which the plate is provided with a number of apertures through which fluid passes to enter the inlet valve in use.

12. A pump as claimed in claim 11 in which the pressure means is a cylinder extending laterally from the valve chamber, provided with a piston.

13. A pump as claimed in claim 12 in which movement of the piston away from the valve chamber in use creates the negative pressure, and in which movement of the piston towards the valve chamber in use creates the positive pressure.

14. A pump as claimed in claim 13 in which the pump is adapted to dispense a viscous liquid, which viscous liquid is contained in a container, which is mounted in use to one end of an inlet conduit, and in which the inlet valve is disposed at the opposite end of the inlet conduit.

15. A pump as claimed in claim 2 in which a negative pressure required to lift the flange portion from the first valve seat is less than a negative pressure required to lift the second tapered portion from the second valve seat, such that in use when a negative pressure is applied to the valve chamber the inlet valve opens and the outlet valve does not.

16. A pump as claimed in claim 3 in which a negative pressure required to lift the flange portion from the first valve seat is less than a negative pressure required to lift the second tapered portion from the second valve seat, such that in use when a negative pressure is applied to the valve chamber the inlet valve opens and the outlet valve does not.

17. A pump as claimed in claim 4 in which a negative pressure required to lift the flange portion from the first valve seat is less than a negative pressure required to lift the second tapered portion from the second valve seat, such that in use when a negative pressure is applied to the valve chamber the inlet valve opens and the outlet valve does not.

18. A pump as claimed in claim 5 in which a negative pressure required to lift the flange portion from the first valve seat is less than a negative pressure required to lift the second tapered portion from the second valve seat, such that in use when a negative pressure is applied to the valve chamber the inlet valve opens and the outlet valve does not.

19. A resilient valve element adapted for use with a valve chamber having first and second valve seats comprising a valve body including axially opposite end portions and a medial portion therebetween; a first of said axial end portions including a flange defined by a first tapered portion directed radially outwardly and in a direction away from a second of said axial end portions and merging at a peripheral portion with a terminal tapered portion directed radially outwardly and in a direction toward said second axial end portion; said terminal tapered portion defining a first valve element, said medial portion having an exterior frusto-conical portion defining a second valve element, and a positive pressure applied to said first tapered portion by pressure means in use lifts the second valve element from the second valve seat.

20. The resilient valve element as defined in claim 19 wherein said valve body defines an interior bore closed at said second axial end portion.

21. The resilient valve element as defined in claim 19 wherein said frusto-conical portion reduces in size in a direction toward said second axial end portion.

22. The resilient valve element as defined in claim 20 wherein said frusto-conical portion reduces in size in a direction toward said second axial end portion.

* * * * *